US010150272B2

(12) United States Patent
Chiang

(10) Patent No.: US 10,150,272 B2
(45) Date of Patent: Dec. 11, 2018

(54) AIR BAG MACHINE

(71) Applicant: Tung-Lung Chiang, New Taipei (TW)

(72) Inventor: Tung-Lung Chiang, New Taipei (TW)

( * ) Notice: Subject to any disclaimer, the term of this patent is extended or adjusted under 35 U.S.C. 154(b) by 644 days.

(21) Appl. No.: 14/818,320

(22) Filed: Aug. 5, 2015

(65) Prior Publication Data

US 2017/0036789 A1 Feb. 9, 2017

(51) Int. Cl.
*B31D 5/00* (2017.01)

(52) U.S. Cl.
CPC ..... *B31D 5/0073* (2013.01)

(58) Field of Classification Search
CPC ..... B31F 5/0073; B31F 5/0039
USPC ..... 53/79
See application file for complete search history.

(56) References Cited

U.S. PATENT DOCUMENTS 8,056,598 B2 * 11/2011 Chiang ..... B29C 65/222 156/497
2006/0059865 A1 * 3/2006 Yampolsky ..... B31D 5/0073 53/403
2006/0168912 A1 * 8/2006 Calogero ..... B29C 49/0047 53/403
2006/0289108 A1 * 12/2006 McNamara, Jr. .... B31D 5/0073 156/147

* cited by examiner

*Primary Examiner* — Andrew M Tecco
*Assistant Examiner* — Chelsea Stinson
(74) *Attorney, Agent, or Firm* — Leong C. Lei

(57) ABSTRACT

The present invention relates to an air bag machine. The operational steps of the machine mainly includes: first, placing bag film on a main body, and extending one end of the bag film to pass through a sealing device and material pulling module in sequence. Subsequently, the bag film is pulled to the rear end by the material pulling module when air filling is carried out to the bag film, and at the same time, the bag film is cut to form a hole entrance by a cutting element so as to facilitate filling air into the bag film Thereafter, the sealing device is used to seal the hole entrance to complete the sealing of the finished bag film.

6 Claims, 9 Drawing Sheets

AIR BAG MACHINE

TECHNICAL FIELD OF THE INVENTION

The present invention relates to an air bag machine, and more particularly to an air bag machine, which is simple in structure, small in volume, and capable of producing a thin film with a buffering effect.

DESCRIPTION OF THE PRIOR ART

For example, Taiwan Patent No. M297906, titled "air bag sealing machine", is proposed. The main action thereof is allowing the upper and lower bag edge of the opening of a package bag to subject to thermal integration to form an air bag by means of a roller driving a metal belt and a rear transmission belt being displaced reversely synchronously.

Although the patent claims an advantage of high efficiency, it is essentially very complicated in structure, further leading to a high cost and the easy departure and dislocation during a bag film is driven to move forward due to the lack of direction guiding and position limiting means. As a result, the quality of the air bag is not good, and the machine even cannot be operated smoothly.

SUMMARY OF THE INVENTION

The main object of the present invention is to provide an air bag machine, capable of obtaining the direction guide, uneasy departure and dislocation and no influence on the quality of air bags by means of the location correspondence and operational relationship.

To achieve the object mentioned above, the present invention proposes an air bag machine, including a main body, material pulling module, sealing device and air filling device, where the front end of the main body allows a bag film to be mount on, the material pulling module is configured on the rear end thereof and adapted to drive the bag film, and the sealing device is configured at one side of the material pulling module; and more importantly, the air filling device further includes a cutting element, thereby extending one end of the bag film to pass through the sealing device and material pulling module in sequence after another end thereof is put around the main body to start the operation. As to the actuation of the operation, the material pulling module pulls to move the bag film toward the rear end, and at the same time, the cutting element cuts open the bag film to form a hole entrance thereon, allowing air to enter the bag film through the hole entrance. Thereafter, the hole entrance is sealed by the sealing device immediately such as by means of hot sealing so as to complete the production of the air bag.

DETAILED DESCRIPTION OF THE PREFERRED EMBODIMENTS

Figure 1:
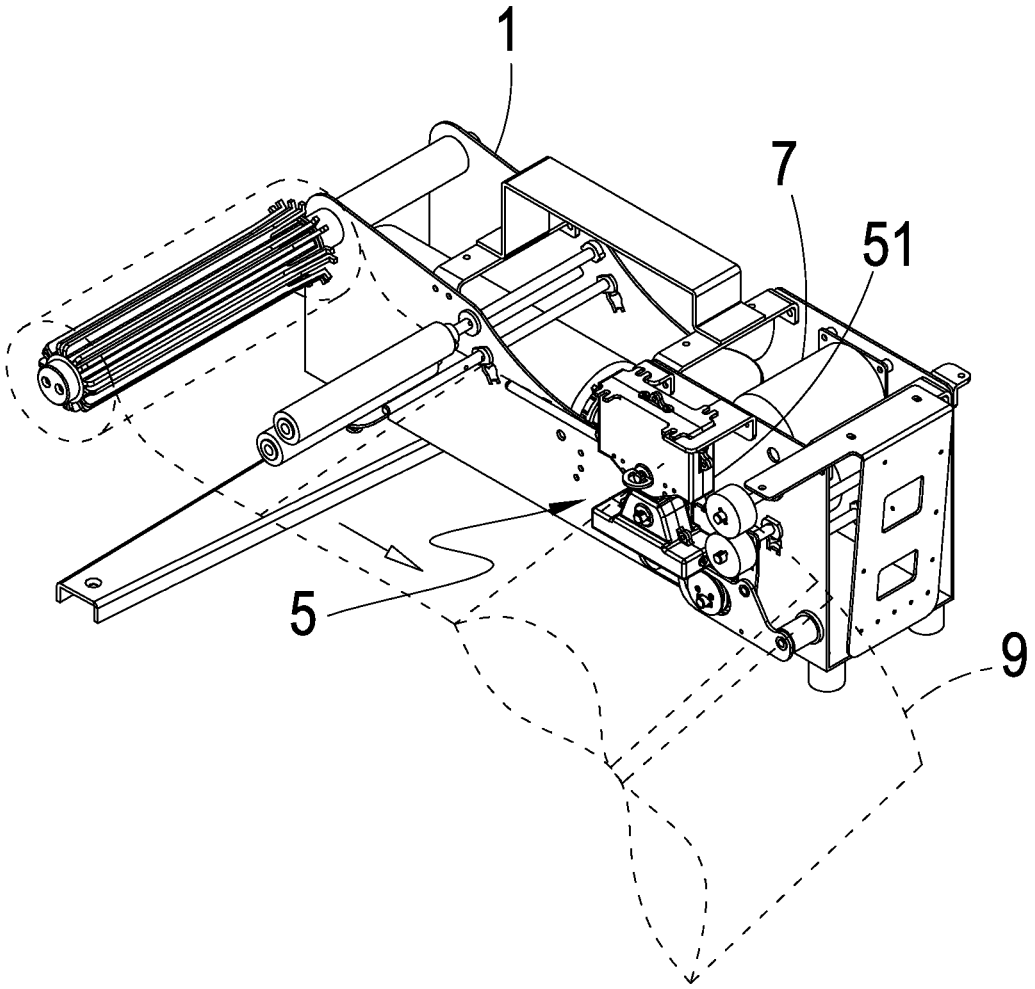
FIG. 1 is a perspective view of the present invention.
Figure 2:
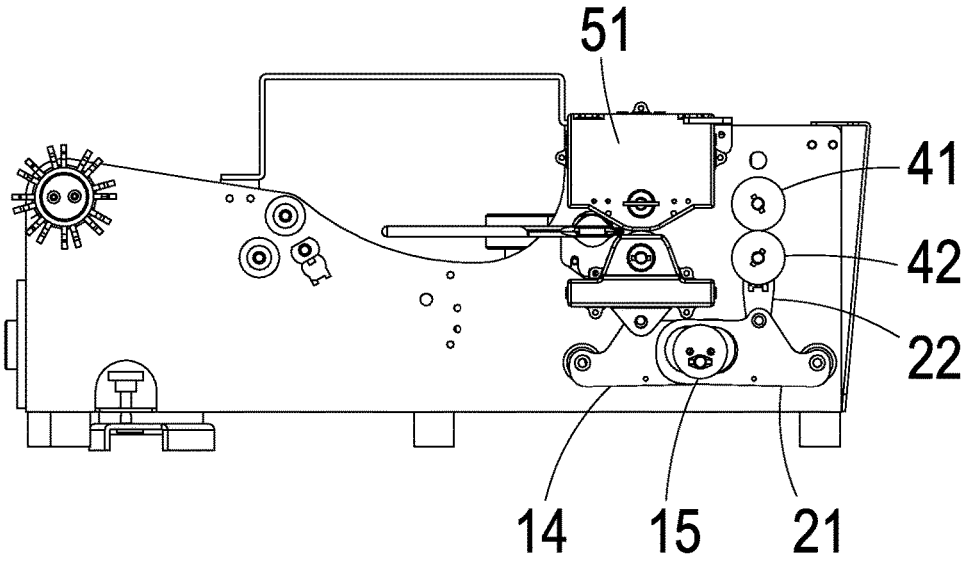
FIG. 2 is a front view of the present invention.
Figure 3:
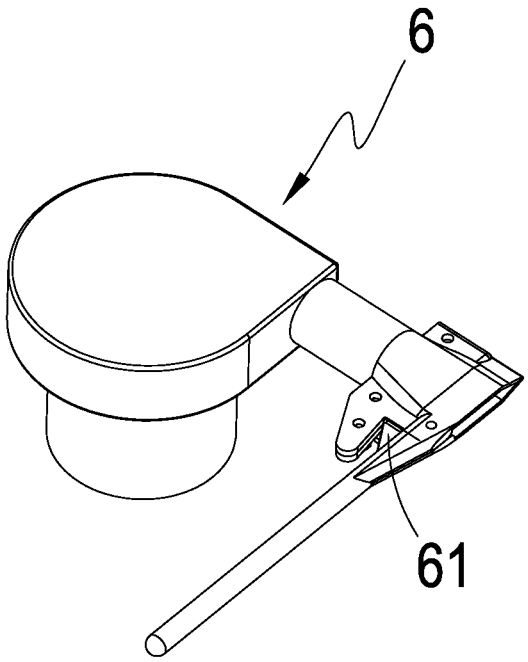
FIG. 3 is a schematically perspective view of the air filling device.
Figure 4:
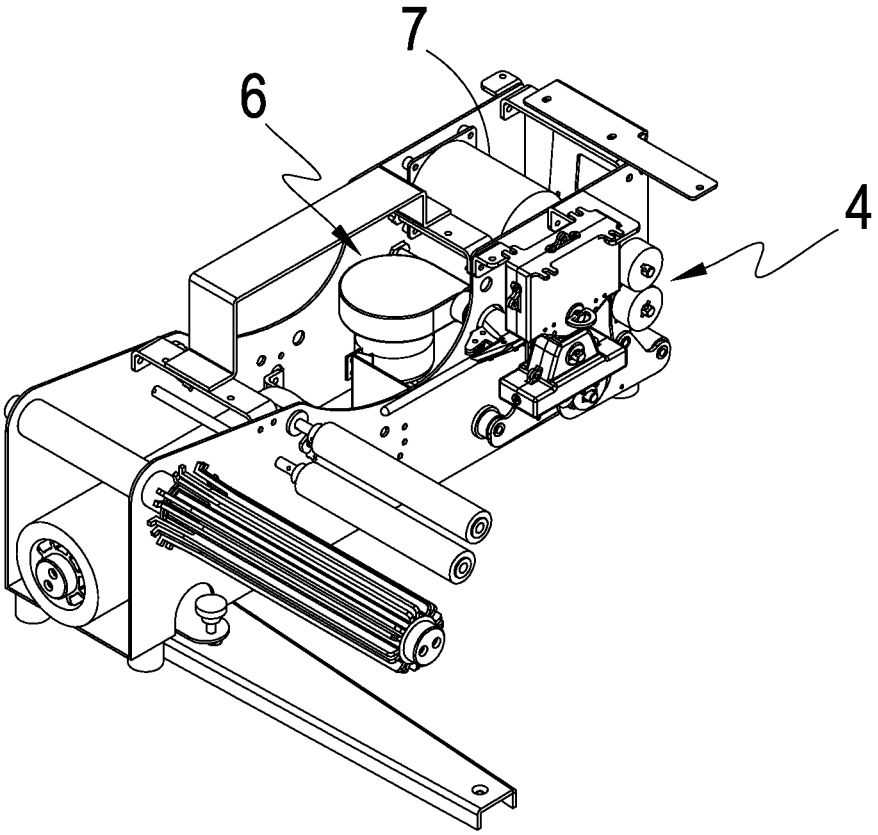
FIG. 4 is a schematically perspective view of the driving device.
Figure 5:
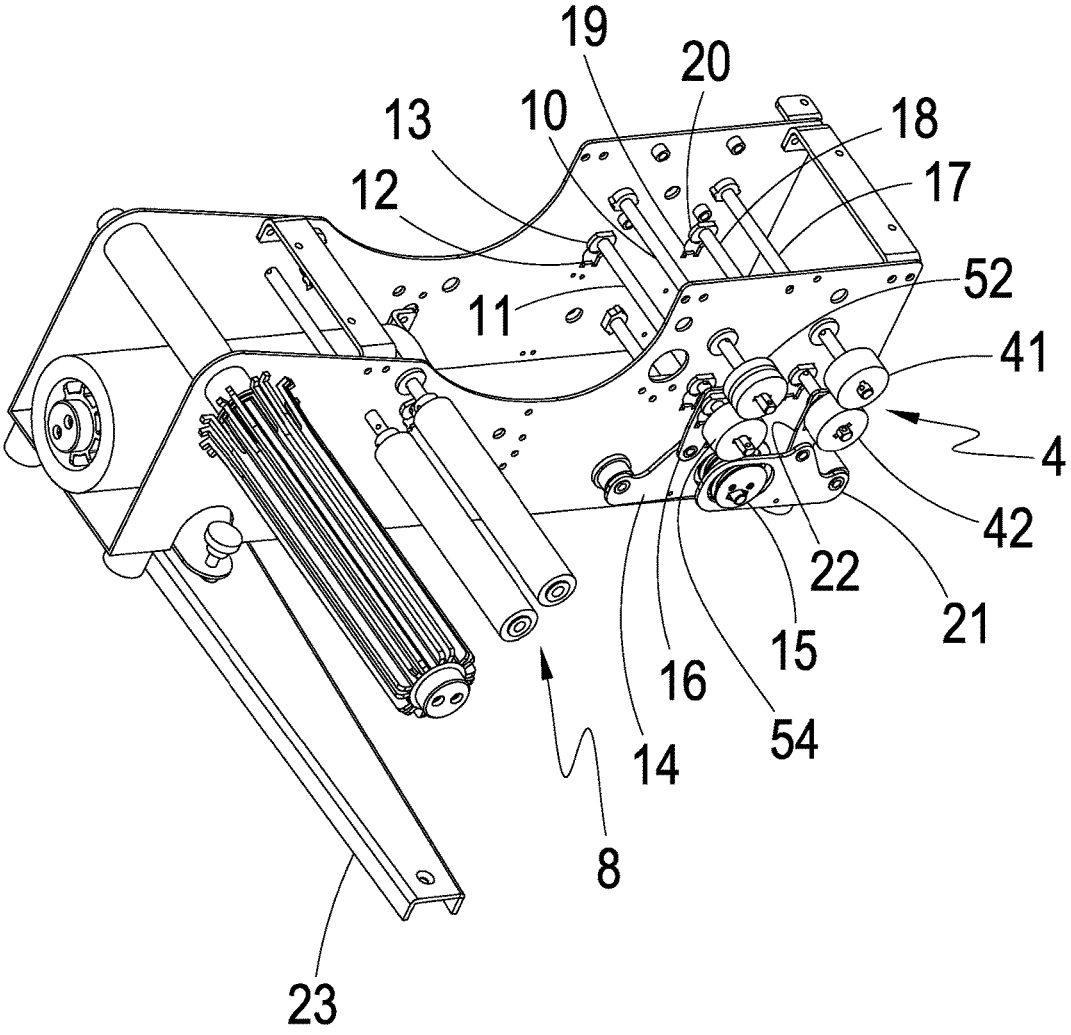
FIG. 5 is a perspective view of the present invention viewing from another angle.
Figure 6:
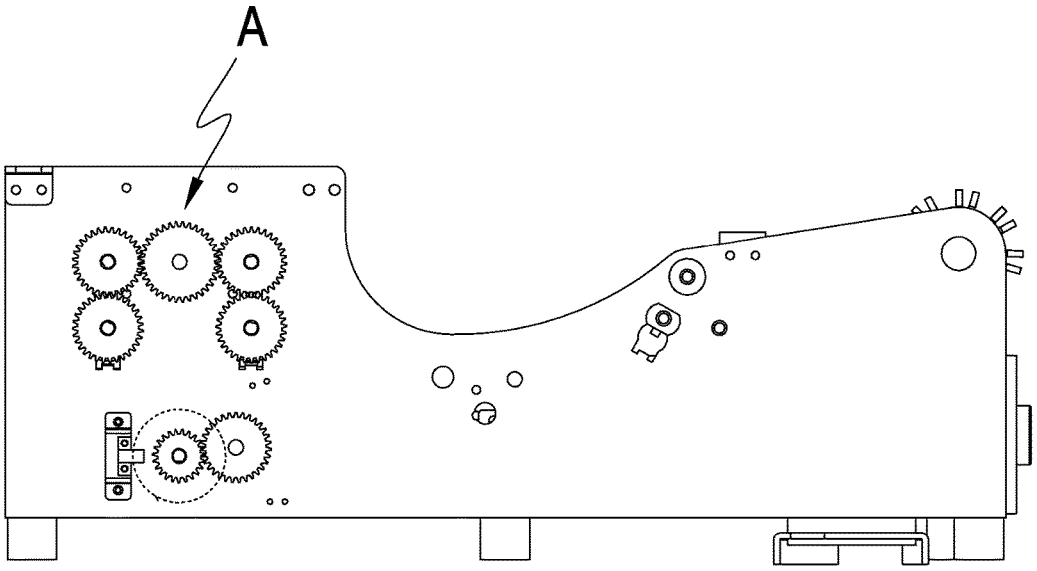
FIG. 6 is a rear view of the present invention.
Figure 7:
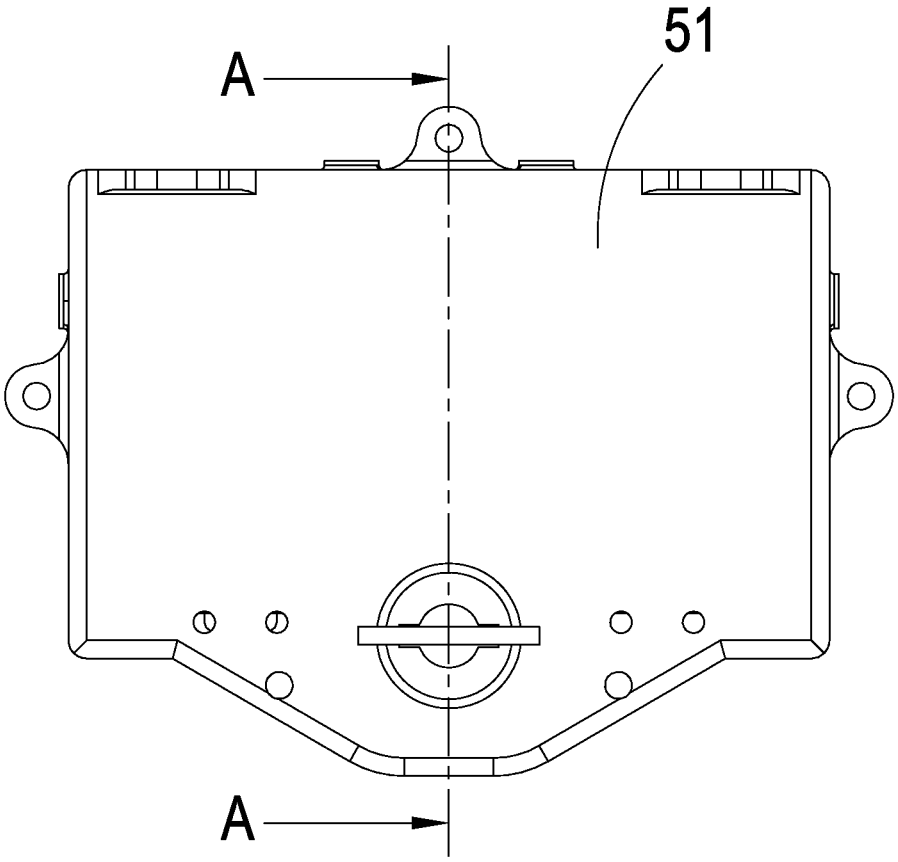
FIG. 7 is a front view of the sealing device'
Figure 8:
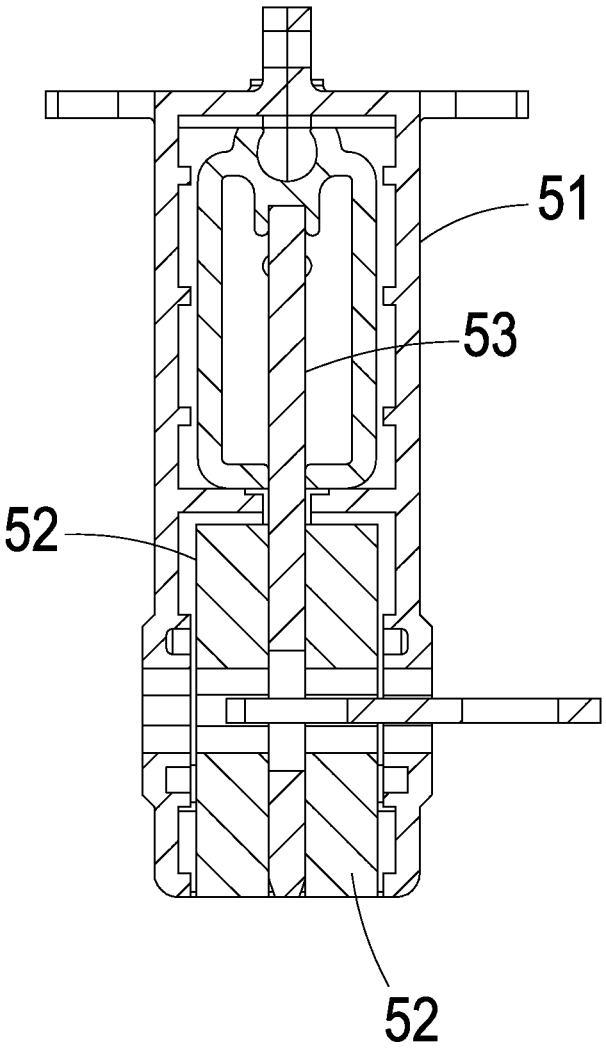
FIG. 8 is a cross-sectional view of the present invention taken along line A-A shown in FIG. 7.
Figure 9:
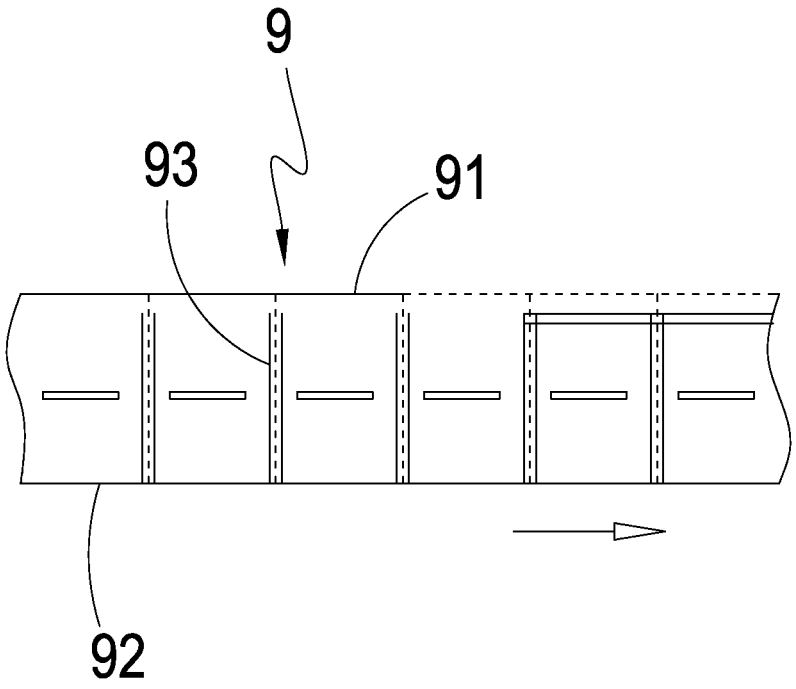
FIG. 9 is a schematic view of a bag film used in the present invention.

Referring to FIGS. 1 to 9, it can be seen from the figures that an air bag machine includes:

a main body 1, inside which upper, lower roller shafts 10, 11 are respectively configured, where one end of the upper roller shaft 10 is coupled to a upper roller 52 described below, and one end of the lower roller shaft 11 a lower roller 54 described below, the main body 1 being further formed with a pair of roller sliding slot 12 allowing each end of the lower roller shaft 11 to be moved along the respective roller sliding slot 12 through a roller bearing 13, the lower roller being further coupled to a roller lift module 14, one end of which is coupled to the main body 1 and another end of which is in contact with a cam 15, and the middle portion of the roller lift module 14 being coupled to the lower roller shaft 11 through a roller connecting piece 16; furthermore, inside the main body being further configured with upper, lower material pulling shaft 17, 18, ends of which are respectively coupled to a material pulling module 4 described below, and the main body 1 being further formed with a pair of material pulling slide slots 19 allowing each end of the lower material pulling shaft 18 to be moved along the respective material pulling slide slot 19 through a material pulling bearing 20, the lower material pulling shaft 18 being coupled to a material pulling lift module 21, one end of which is coupled to the main body 1 and another end of which is in contact with the cam 15, and the middle portion of the material pulling lift module 21 being coupled to the lower material pulling shaft 18 through a material pulling connecting piece 22; furthermore, the bottom of the main body 1 being coupled to a rotating support 23;

the material pulling module 4, configured on the rear end of the main body 1 and adapted to drive a bag film to move, and including at least one pair of upper, lower material pulling wheels 41,42 in positional correspondence with each other, one of the upper, lower material pulling wheels 41,42 being movable vertically and freely.

a sealing device 5, configured at one side of the material pulling module 4, including an outer shell configured on the main body 1, a heating module 53 configured inside the outer shell and adjacently to at least one upper roller 52, and at least one lower roller 54 configured inside the outer shell 51 in positional correspondence with the upper roller 52, where the heating module 53 is configured between each two adjacent upper rollers 52 if more than one upper roller 52 is configured correspondingly; furthermore, one of upper, lower rollers 52, 54 being movable vertically and freely;

an air filling device 6, configured at one side of the sealing device 5, including a cutting element 61;

a driving device 7, combined with the main body 1;

a gear transmission mechanism, combined with the driving device 7, and coupled to the upper, lower rollers 52,54 and the material pulling module 4;

one pair of clamping modules, coupled pivotally to the main body 1 and parallel to the material pulling module 4.

Upon operation, the bag film 9 is first put around the main body 1. Subsequently, one end of the bag film 9 is extended to wear around the clamping modules 8 and then extended continuously to pass through the cutting element 61, sealing device 5 and the air filling device 6 between the both. Finally, the bag film 9 is combined with the material pulling module 4. Furthermore, the upper roller 52, lower roller 54 and material pulling module 4 are driven synchronously via the gear transmission mechanism through the driving device 7 to cause the bag film 9 to be pulled to move by the material pulling module 4, and the bag film 9 is cut to form a hole entrance through the cutting element 61 when the bag film 9 is moved to the end of the main body 1, with air being filled into the bag film 9 immediately via the hole entrance to carry out an expansion thereof and the bag film 9 being then pressed and positioned immediately by the upper roller 52 and lower roller 54, thereby facilitating the hot sealing of the hole entrance carried out by the heating module 53.

The further details about the installment steps will be described in the following. In the initial state, the lower material pulling shaft 18 and lower roller shaft 11 are at the lowest positions, and the upper, lower material pulling wheels 41, 42 are caused to separate by a definite distance, and also, the upper, lower rollers 52, 54 a definite distance, thereby being convenient for the bag film 9 to pass through between the upper, lower material pulling wheel 41,42 and between the upper, lower rollers 52, 54. Thereafter, the pre-heating of the sealing device 5 can be carried out by starting the air bag machine after the bag film 9 is installed. At this time, both the roller lift module 14 and material pulling lift module 21 are at the lowered positions; the upper material pulling wheel 41 is separated from the lower material pulling wheel 42, and the upper roller 52 the lower roller 54 so as to prevent the bag film 9 from being scalded during the pre-heating of the sealing device 5. Next, the upper, lower material pulling wheel 41,42 and the upper, lower roller 52, 54 start rotating to cause the roller lift module 14 and material pulling lift module 21 to be raised such that the upper material pulling wheel 41 is in contact with the lower material pulling wheel 42, and the upper roller 52 the lower roller 54. As a result, the bag film 9 is driven to move forward, starting the production of the air bag.

In addition, the rotating support 23 may be rotated to facilitate the storage and transportation of the air bag machine when the air bag machine is intended to store for transportation.

Furthermore, both the first and second sides 91,92 of the bag film 9 are sealed hermetically, and a solid connection 93 between the first, second sides 91, 92 is respectively configured in each fixed distance to combine the upper and upper bag films 9 with each other. Thereupon, an accommodation chamber is formed between each two adjacent solid connections 93, allowing air to be filled therein so that a plurality of air bags can be formed after the air filling and sealing.

For clarity, the actuation relationship among each sliding slot, each connection piece and each cam is herein further explained. The roller lift module 14 and material pulling lift module 21 are configured adjacently to each other, and one end of the roller lift module 14 and one end of the material pulling lift module 21 are respectively coupled to the main body 1, and the other ends thereof are coupled pivotally to the cam 15 together. In addition, the roller lift module 14 and material pulling lift module 21 are respectively coupled to the lower roller shaft 11 and lower material pulling shaft 18 through the roller connecting piece 16 and material pulling connecting piece 22. Therefore, the lower roller shaft 11 and lower material pulling shaft 18 are driven to move up and down through the roller lift module 14, material pulling lift module 21 and the roller connecting piece 18, material pulling connecting piece, and at the same time, the lower roller shaft 11 is driven to move the roller bearing 13 to slide up and down along the roller sliding slot 12, and the lower material pulling shaft 18 is driven to move the material pulling bearing 20 to slide up and down along the material pulling sliding slot 19 as well.

Furthermore, the driving device 7 is respectively geared with the upper material pulling shaft 17, upper roller shaft 10, lower material pulling shaft 18 and lower roller shaft 11 through a plurality of gear trains, allowing it to drive the upper material pulling shaft 17, upper roller shaft 10, lower material pulling shaft 18 and lower roller shaft 11 to move smoothly.

I claim:

1. An air bag machine, comprising:

a main body;

a material pulling module, configured on a rear end of said main body and adapted to drive a bag film, comprising at least one upper material pulling wheel and lower material pulling wheel in positional correspondence with each other, and one of said upper material pulling wheel and lower material pulling wheel being movable vertically and freely;

a sealing device, configured at one side of said material pulling module, comprising a heating module in combination with said main body, at least one upper roller and lower roller in positional correspondence with each other being configured adjacently to said heating module, and one of said upper roller and lower roller being movable vertically and freely;

an air filling device, configured at one side of said sealing device, comprising a cutting element adapted to cut said bag film;

wherein an upper roller shaft and lower roller shaft are respectively configured inside said main body, one end of said upper roller shaft is coupled to said upper roller and said lower roller shaft, and a pair of roller sliding slots are formed on said main body, allowing two ends of said lower roller shaft to be moved along the respective roller sliding slots through a roller bearing, and the lower roller shaft is coupled to a roller lift module;

wherein one end of said roller lift module is coupled to said main body, and another end thereof is in contact with a cam, with a middle portion of the roller lift module being coupled to said lower roller shaft through a roller connecting piece;

wherein an upper material pulling shaft and lower material pulling shaft are respectively configured inside said main body, one end of said upper material pulling shaft and one end of said lower material pulling shaft are respectively coupled to said material pulling module, and said main body is further formed with a pair of material pulling sliding slots, allowing two ends of said lower material pulling shaft to be moved along respective material pulling sliding slot through a material pulling bearing, with said lower material pulling shaft being coupled to a material pulling lift module;

wherein one end of said material pulling lift module is coupled to said main body, and another end thereof is in contact with said cam, with a middle portion of said material pulling lift module being coupled to said lower material pulling shaft through a material pulling connecting piece; and wherein said roller lift module and said material pulling life module are both coupled to said cam so that said cam drive said lower roller shaft and said lower material pulling shaft to move through a combination of said roller lift module and said roller connecting piece and a combination of said material pulling lift module and said material pulling connecting piece, respectively.

2. The machine according to claim 1, wherein said at least one upper roller comprises two upper rollers between said heating module is arranged.

3. The machine according to claim 1, further comprising:

a driving device, in combination with said main body; and a gear transmission mechanism, in combination with said driving device, and coupled to said upper roller, lower roller and material pulling module.

4. The machine according to claim 1, further comprising a pair of clamping modules coupled pivotally and movably to said main body, said clamping modules being parallel to said material pulling module.

5. The machine according to claim 1, wherein a bottom of said main body is coupled to a rotating support.

6. The machine according to claim 1, wherein said sealing device further comprises an outer shell configured on said main body, allowing said heating module, upper roller and lower roller to be accommodated therein.

* * * * *